US010967941B2

(12) United States Patent
Golden et al.

(10) Patent No.: US 10,967,941 B2
(45) Date of Patent: Apr. 6, 2021

(54) WALER ASSEMBLY

(71) Applicants: William Golden, North Fort Myers, FL (US); Mark Summers, Bridgeport, CT (US); Robert W. Christoph, Jr., Miami Beach, FL (US)

(72) Inventors: William Golden, North Fort Myers, FL (US); Mark Summers, Bridgeport, CT (US); Robert W. Christoph, Jr., Miami Beach, FL (US)

( * ) Notice: Subject to any disclaimer, the term of this patent is extended or adjusted under 35 U.S.C. 154(b) by 0 days.

(21) Appl. No.: 16/516,655

(22) Filed: Jul. 19, 2019

(65) Prior Publication Data

US 2020/0047862 A1 Feb. 13, 2020

Related U.S. Application Data

(60) Provisional application No. 62/703,753, filed on Jul. 26, 2018.

(51) Int. Cl.
*B63C 1/02* (2006.01)

(52) U.S. Cl.
CPC ..... *B63C 1/02* (2013.01)

(58) Field of Classification Search
CPC ..... B63C 1/02; B63B 35/53; B63B 35/38; B63B 35/34; B63B 3/02; B63B 3/04; B63B 3/06; B63B 3/08
USPC ..... 114/266
See application file for complete search history.

(56) References Cited

U.S. PATENT DOCUMENTS 4,078,515 A * 3/1978 Svirklys ..... E02B 3/064 114/266
5,845,594 A * 12/1998 Hallsten ..... B63B 35/38 114/263
6,205,945 B1 * 3/2001 Passen ..... B63B 3/06 114/267
6,230,644 B1 * 5/2001 Passen ..... B63B 3/06 114/263
6,364,576 B1 * 4/2002 Passen ..... E02B 3/064 114/267
7,640,881 B1 * 1/2010 Gerst ..... B63B 3/08 114/263
7,784,419 B2 * 8/2010 Bigler ..... B63C 1/02 114/263
8,468,965 B2 * 6/2013 Kor ..... B63B 35/58 114/263
2010/0303538 A1 * 12/2010 Kor ..... F16B 37/047 403/22

* cited by examiner

*Primary Examiner* — Anthony D Wiest
(74) *Attorney, Agent, or Firm* — William E. Noonan

(57) ABSTRACT

A waler assembly for floating docks and walkways includes an elongate metal extrusion for engaging the side of a series of adjoining float components. The extrusion includes a compartment for conformably receiving an elongate wedge. Connector rods join the extrusion and wedge to the float components. The extrusion carries an elongate strengthening plate that extends across the compartment of the extrusion. Each of the extrusion, wedge and strengthening plate includes a plurality of discrete segments that are aligned end to end. The joints between adjoining segments of the waler assembly are offset to provide improved structural integrity of the waler assembly and the floating dock or walkway.

20 Claims, 5 Drawing Sheets

WALER ASSEMBLY

RELATED APPLICATION

This application claims the benefit of U.S. Provisional Application Ser. No. 62/703,753 filed Jul. 26, 2018.

FIELD OF THE INVENTION

This invention relates to a waler assembly and, more particularly, to a waler assembly that is especially effective for use in a floating marine dock or similar structure.

BACKGROUND OF THE INVENTION

Floating marine docks and walkways, and other floating platform structures conventionally employ a waler system that includes structural beams attached to longitudinal sides of the deck or other walking surface of the structure. Most often, the beams comprise structural timbers composed of wood. In known floating docks, the wood beams formed along respective sides of the dock are interconnected to one another by a series of threaded rods mounted through sleeves or other openings formed transversely across the float components of the dock. Appropriate types of nut and washer arrangements are attached to the respective ends of the rods to hold the entire structure in place.

Waler systems of the type described above exhibit a number of disadvantages. Typically, the structural timbers used in the walers are provided in lengths of approximately 16-20 feet. Accordingly, in most docks, a number of generally aligned wood beams must be installed end to end along each side of the floating deck. As a result, each side of the waler usually includes a number of joints or splices formed between successive wood beams. This significantly weakens the overall structure. To address this concern, most waler systems featuring wood beams employ at least two juxtaposed lengths of structural timbers, which are installed longitudinally side by side. Typically, the inner and outer longitudinal beams are staggered so that the joints in the respective lengths of wood beams do not align with one another. Nonetheless, such walers tend to be structurally weaker and more susceptible to failure than optimally desired. When a double set of timbers are used, the effective strength of the waler is limited to the thickness of a single one of the side by side beams, due to the joints between the successive longitudinal pieces.

Waler systems composed of wood tend to experience a number of additional problems. Wood deteriorates and rots over time. This can cause marine cleats attached to the waler to loosen and can also cause eventual structural failure of the dock itself. Moreover, because multiple lengths or layers of wood must be installed along each side of the deck, the waler requires at least twice as much wood as would be otherwise dictated by the nominal length of the dock or walkway. Installing walers of this type can be quite labor intensive, time consuming, expensive, messy and tedious. Repairing standard walers can be similarly inconvenient and problematic. The structural timbers used in most walers typically comprise pressure treated lumber, which has a relatively limited lifespan and is environmentally undesirable to use in many applications.

SUMMARY OF THE INVENTION

It is therefore an object of the present invention to provide a significantly improved waler assembly that is stronger, more durable and more cost effective than conventional wood beam waler systems.

It is a further object of this invention to provide a waler system that is extremely versatile and allows cleats, bumpers, mooring posts and various other boating and marine accessories to be conveniently attached to a dock.

It is a further object of this invention to provide a waler assembly that is particularly effective for use on floating docks and other types of docks and walkways.

It is a further object of this invention to provide a waler assembly that is much quicker, less labor intensive and less expensive to install and maintain than are conventional wood waler systems.

It is a further object of this invention to provide a waler assembly featuring a unique metal and preferably aluminum construction that features a much longer service life and poses less environmental problems than currently available waler systems utilizing pressure treated lumber.

It is a further object of this invention to provide a waler assembly for a deck or similar structure, that provides for at least three laterally abutting layers or lengths of uninterrupted, joint-free structural support on each side of the dock and at all locations across the entire length of the waler assembly such that the dock or other structure supported by the waler is much stronger and resists failure for significantly longer periods of time than conventional waler systems.

It is a further object of this invention to provide a waler assembly that resists damage from rough waves, high winds, saltwater exposure and other harsh marine conditions better than known waler systems.

This invention features a waler assembly for use in a floating dock, walkway or other type of floating platform having a series of buoyant float components juxtaposed in an elongate arrangement to form the floating platform. The waler assembly includes an elongate metal extrusion for securing to a respective longitudinal side of the series of float components. The extrusion includes an interior wall for engaging the sides of one or more of the float components. The extrusion is further configured to define a compartment, which receives a separate and distinct elongate beam. The beam includes an inner panel or web that is engaged with the interior wall of the extrusion. One or more connectors interengage and fasten together the inner panel of the beam, the interior wall of the extrusion and the adjoining float components. The waler further includes a strengthening plate that is attached to an outer portion of the extrusion for covering the compartment that accommodates the beam.

In a preferred embodiment, the extrusion, beam and strengthening plate, each includes a plurality of substantially aligned pieces or segments, which are arranged end to end along a respective side of the series of float components. Typically, a respective waler assembly is connected to each longitudinal side of the series of float components to support and strengthen the overall floating dock or walkway. To optimize this support, the splits, splices, joints or seams between successive float components, and extrusion, beam, and strengthening plate segments are offset from one another so that, at a minimum, three unbroken and joint-free structural surfaces are formed transversely across the waler and adjoining float component at any point or location along the length or span of the dock structure. This significantly increases the strength of the wafer assembly and the overall dock. As a result, the floating dock or walkway is better able to resist damage from rough waves, seas, high winds and/or inclement conditions.

The extrusion may include top and bottom portions that interconnect the inner wall and outer portion of the extrusion. The outer portion of the extrusion may include a pair of notches for respectively receiving upper and lower sections of the strengthening plate. One or more fasteners may interconnect at least one of the longitudinal upper and lower sections of the plate to the outer portion of the extrusion. At least one of the notches may include an elongate slot for receiving a respective one of the lower and upper sections of the plate to hold the plate in place against the extrusion. The strengthening plate may include a substantially planar upper section and a lower section that is angularly offset from the planar upper section. This lower section may fit in the slot of the extrusion to secure the plate to the extrusion. The extrusion may also include a second longitudinal compartment which receives an elongate tubular metal spacer for adding structural strength to the waler.

Each connector that fastens the beam and extrusion to the adjoining float components may include a threaded connector rod that extends through the inner panel of the beam, the interior wall of the extrusion and an adjoining float component. A proximal first end of the connector rod may be threadably interengaged by a fastening nut and washer assembly or other means of attachment. The opposite, distal end of the connector rod may extend into a utility trough formed centrally and longitudinally through the float component. A metal inner U-channel may interengage a side wall of the trough from which the connecting rod protrudes. Appropriate nuts or comparable fasteners may be threadably interengaged with the protruding inner end of the connecting rod and tightened against the inner U-channel to secure the waler assembly to the float component. A comparable structure may be employed on the opposite longitudinal side of the dock for holding the second longitudinal waler in place. One or more of the top, bottom and outer portions of the extrusion may include a respective mounting channel formed unitarily into the extrusion. These mounting channels may receive various accessories associated with the dock such as cleats, mooring posts, utility stands, benches and additional dock sections.

An outer surface of the strengthening plate may be interengaged by and attached to a vessel cushioning bumper. More particularly, a threaded bumper connector may be interengaged through aligned fastening holes in the strengthening plate and a bottom surface of the bumper such that a threaded end of the bumper connector extends into the compartment of the extrusion, Before the plate is mounted to the extrusion, the bumper can be attached to the plate and secured thereto by a fastening nut that engages the threaded bumper connector. The strengthening plate and attached bumper can then be attached to the extrusion by inserting one longitudinal edge of the strengthening plate to the slot in the extrusion and attaching the opposite edge to a notch in the extrusion by an appropriate screw or other fastener.

The beam is preferably defined by an elongate outer channel having a spaced apart pair of upper and lower legs or flanges interconnected by the interior panel or web. The legs may respectively interengage opposing upper and lower walls of the extrusion compartment.

BRIEF DESCRIPTION OF THE DRAWINGS

Other objects, features and advantages will occur from the following description of a preferred embodiment and the accompanying drawings, in which.

DETAILED DESCRIPTION OF PREFERRED EMBODIMENTS

Figure 1:
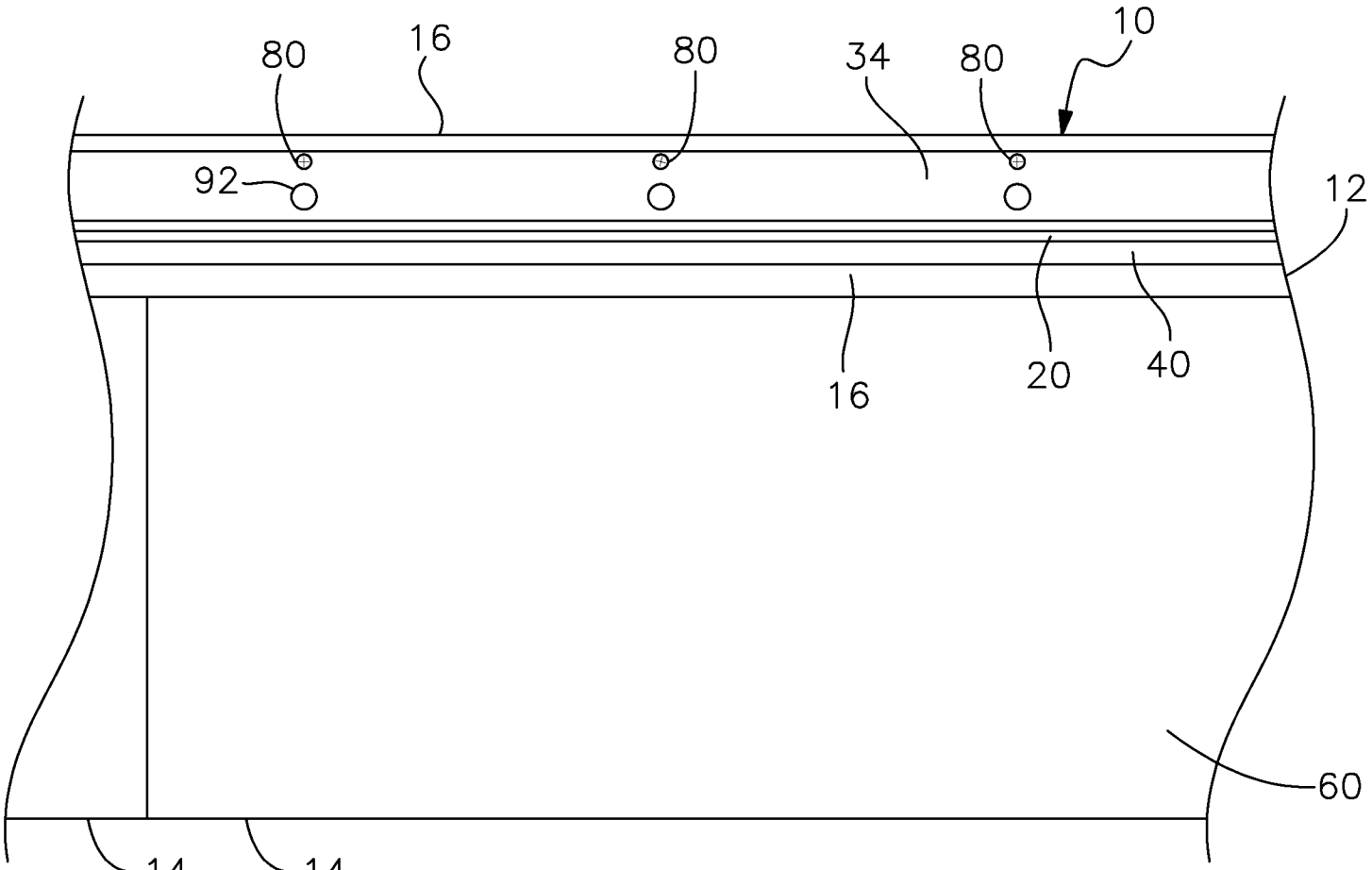
FIG. 1 is an elevational, fragmentary view of a floating dock employing a waler assembly in accordance with this invention.

There is shown in FIG. 1 a metal waler assembly 10 for use in a floating dock 12. Floating docks and analogous walkways are well known in and disclosed for example in U.S. Pat. Nos. 6,205,945, 6,230,644 and 6,364,576. As shown in those references and elsewhere in the prior art, floating docks typically comprise a series of individual float components or modules 14, which are tied together and significantly strengthened by the waler assembly 10 of this invention. It should be understood that the waler assembly may be used to tie together and strengthen various types of floating platform structures including, but not necessarily limited to, floating docks and walkways. The particular type of dock, walkway or analogous floating platform structure that utilizes waler assembly 10 is not a limitation of this invention. As used herein, "platform" and "floating platform structure" should be understood to include docks, walkways and other supportive platforms designed to float in a marine environment or other body of water.

Figure 2:
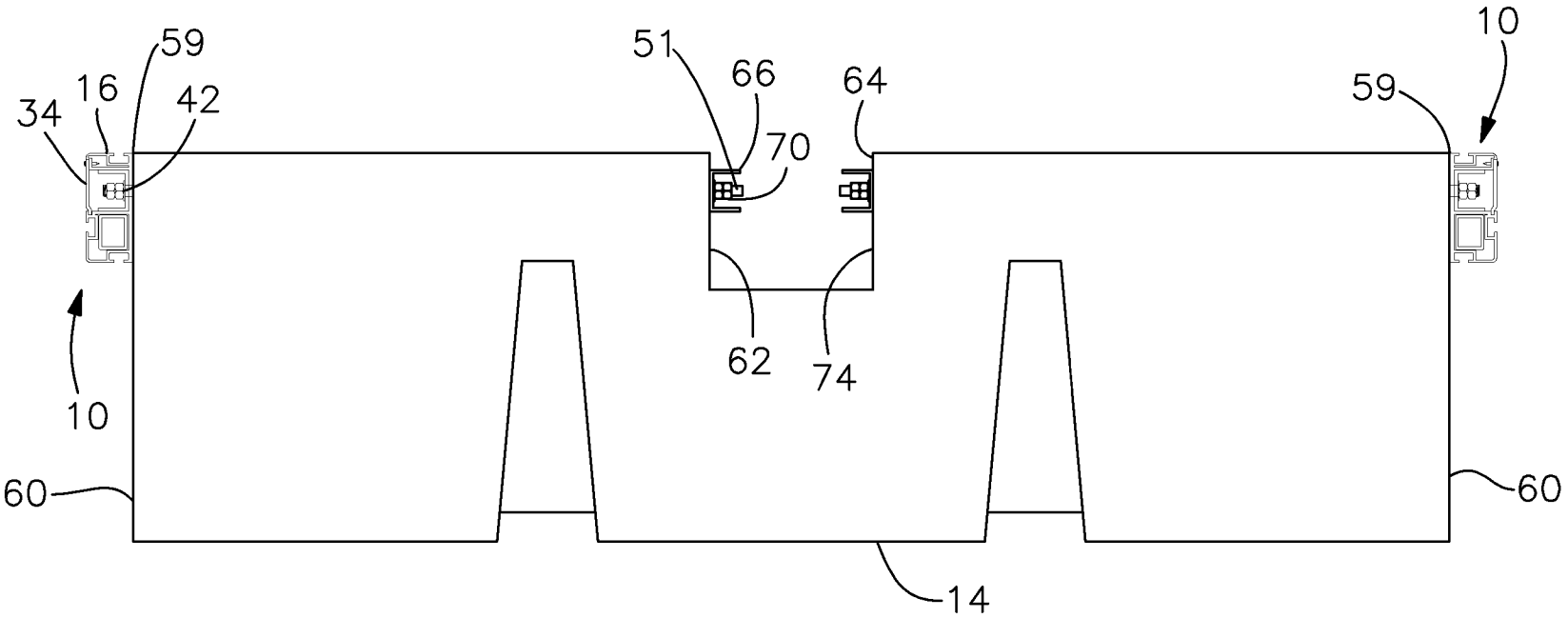
FIG. 2 is an elevational, cross sectional view of a pair of waler assemblies operatively interconnected to respective sides of a representative one of the float components of the floating dock.
Figure 3:
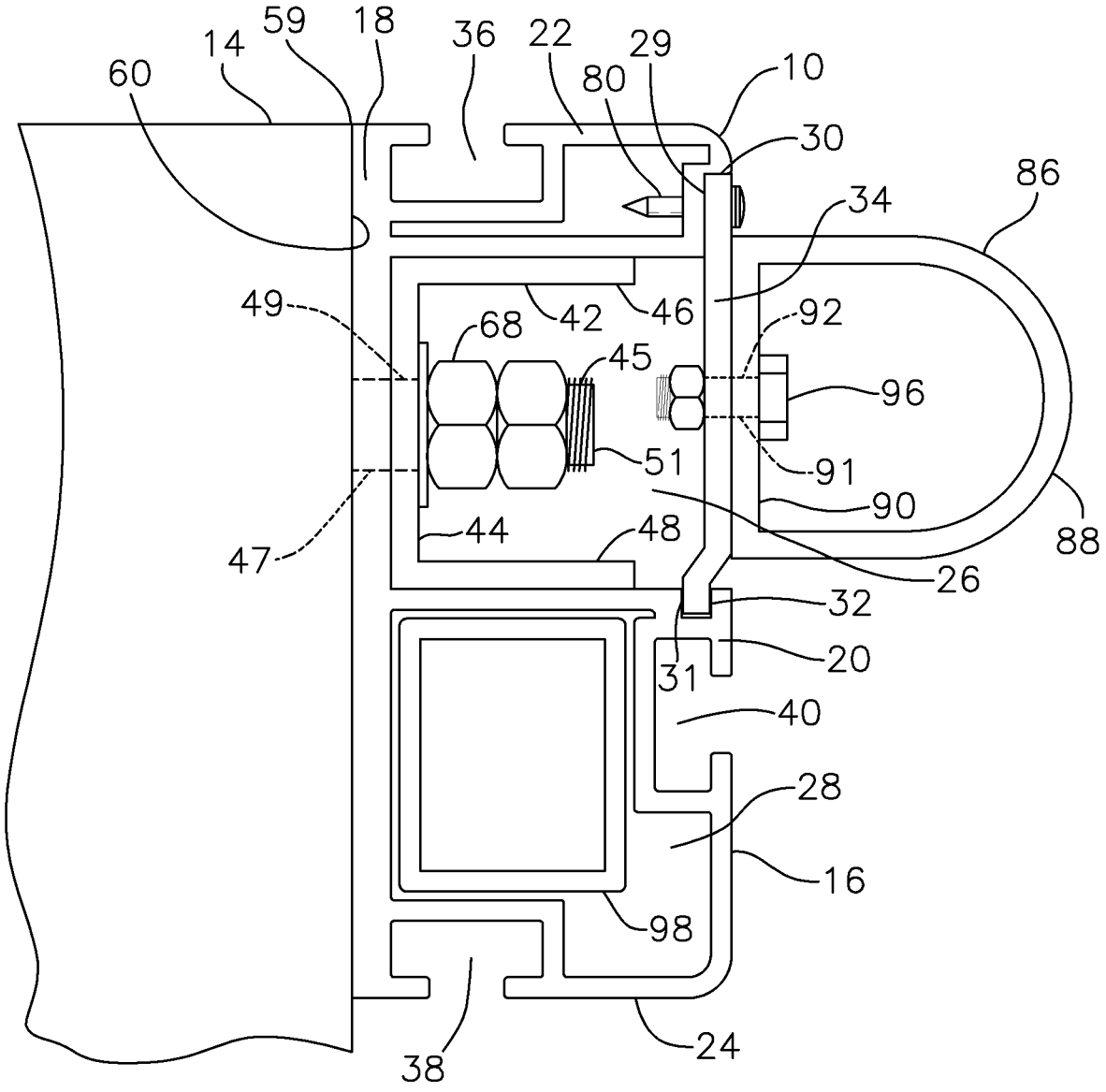
FIG. 3 is a cross sectional view illustrating the constituent components of the waler assembly.

Referring to FIGS. 1-3, waler assembly 10 includes an elongate metal extrusion 16 having a preferred profile as best depicted in FIG. 3. It is especially preferred that the extrusion, as well as the other individual components of waler assembly 10, which are described below, be composed of aluminum of a type typically employed in marine applications. Alternative metals, metal alloys and corrosion-resistant synthetic materials may be employed, although in all cases, the extrusion and other components of the waler should be relatively lightweight, and yet strong, durable somewhat flexible and resistant to saltwater corrosion and other harsh marine conditions. Extrusion 16 may be formed in various selected lengths and each waler assembly 10 typically comprises a plurality of discrete, aligned extrusion pieces (also designated as 16) arranged end to end along the both sides of the dock.

As best shown in FIG. 3, each extrusion piece 16 includes an interior wall 18, an outer portion 20, and top and bottom end portions 22 and 24 that interconnect interior wall 18 and outer portion 20. The profile of extrusion piece 16 is configured to include an upper first upper compartment 26 and a second lower compartment 28. Outer portion 20 of extrusion piece 16 includes an upper notch 29 and an opposing lower notch 31 defining a slot, which are configured for respectively receiving the upper section 30 and the lower section 32 of an elongate and preferably aluminum (or other metal) strengthening plate 34 (FIGS. 2, 3). Plate 34 is formed in discrete end to end segments, which extend longitudinally through and are attached to aligned extrusion pieces 16, as described more fully below. Each extrusion piece is also configured to include mounting channels 36, 38 and 40, which are formed respectively in top and bottom portions 22, 24 and outer portion 20 of extrusion piece 16.

Waler assembly 10 further includes an elongate beam 42, FIGS. 2 and 3, which is composed of aluminum or other durable metal or synthetic material. The beam is received conformably within the compartment 26 of each aligned extrusion piece 16. More particularly, beam 42 is defined by an elongate outer channel that has a generally U-shaped cross sectional configuration. The beam features a flat inner panel or web 44, which flushly engages interior wall 18 of extrusion 16 and flat legs or flanges 46 and 48 that likewise flushly interengage corresponding interior walls of upper compartment 26. As with extrusion 16 and strengthening plate 34, beam 42 typically comprises a plurality of discrete elongate segments (likewise designated by reference numeral 42) that are generally aligned end to end within the aligned extrusion pieces of the waler assembly. Nonetheless, it is very important to note, that the joints or splices between successive adjoining beam segments 42 are staggered relative to and do not align with the joints or splices formed between successive adjoining extrusion pieces 16 that laterally abut the beam segments. By the same token, the joints or seams between the successive strengthening plates 34, beam segments 42 and extrusion pieces 16 are staggered relative to one another and relative to the joints between the laterally abutting, longitudinally juxtaposed float components 14. The seams between the successive float components, extrusion pieces, beam segments and strengthening plates are never laterally aligned. This feature is extremely important and provides substantial resulting benefits as described more fully below.

Waler assembly 10 is installed in dock 12 by engaging interior wall 18 of extrusion 16 against the upper edge 59 of side walls 60 of the adjoining float components 14. See FIGS. 1-4 and more particularly FIGS. 2 and 3. As best shown in FIG. 3, the interior wall 18 of extrusion 16 and the inner panel 44 of beam 42 include a series of corresponding connector holes 47, 49. Each corresponding pair of connector holes accommodates a respective connecting rod 51 for securing wafer assembly 10 to float components 14. Extrusion 16 is oriented against the side of the engaged float components 14 such that the connector holes 47 formed through interior walls 18 are aligned with corresponding mounting holes and/or tubular sleeves (not shown) formed transversely through the float components in a similar fashion. Conventional floating docks and waler system likewise utilize threaded rods for interconnecting the waler system to the float components. The manner of mounting connecting or mounting rods through the float components will be known to persons skilled in the art. See the patents cited in the Background of the Invention. It should be noted that a number of such corresponding connector holes and connecting rods are provided along the length of the waler assembly in a similar manner to that shown in FIGS. 1-4. The particular preferred manner of fastening the waler assembly to the float components is described more fully below.

Beam 42 is inserted conformably into extrusion compartment 26 such that corresponding pairs of connecting holes 47 and 49 are aligned and likewise aligned with the transverse hole or sleeve formed through the float component. As shown specifically in FIG. 2, representative a threaded connector rod 51 is mounted transversely through a representative pair of aligned holes 47 and 49 (FIG. 3) and through the transverse opening (not shown) in the adjacent float component 14 such that a distal end of rod 51 protrudes from left-hand side wall 62 of a utility trough 64 formed centrally and longitudinally through the upper surface of float component 14. One or more connector rods, with threads at each end, may be installed in a similar manner through respective connector holes 47, 49 formed in the waler segments and corresponding transverse openings formed through the juxtaposed series of float components. As shown in FIG. 2, an elongate metal inner U-channel 66 having corresponding connector openings (not shown) is engaged with the inner or distal end of each connector rod 51. A nut and washer assembly 45 featuring two nuts 68, FIG. 3, is secured to the threaded connector rod within the waler assembly 10 and tightened against inner panel 44 of beam 42. A similar nut and washer arrangement 70 is likewise threadably secured to the distal end of connector rod 51 within channel 66 and tightened against U-channel 66 as shown in FIG. 2. Each connector rod 51 is fastened in place in an analogous manner. The number of connector rods and interconnected nut and washer assemblies employed at respective ends of the connector rods may be varied within the scope of this invention. As a result, aligned extrusion pieces 16 of waler assemblies 10 are secured to one side of the aligned float components. As best shown in FIG. 2, a similarly constructed second wafer assembly 10 on the opposite (e.g. right-hand) side of the juxtaposed float components 14 may be secured in an analogous manner with the distal end of each connector rod extending through the right hand side wall 74 of central utility trough 64. As a result, the juxtaposed float components 14 are tied and supported securely together by the attached waler assemblies 10 that extend along respective longitudinal sides of the dock.

After the aligned extrusion pieces and beam segments are secured to the floating dock components in the foregoing manner, one or more aligned strengthening plate segments 34 may be installed. As previously described, an upper longitudinal edge 30 of each plate 34 is conformably engaged with an upper notch 29 in extrusion 16. The angularly offset lower edge 32 of plate 34 is fit into conforming slot 31 formed in outer portion 20 of extrusion 16. Plate 34 is then secured to extrusion 16 by one or more screws or other connectors 80 formed through aligned connecting holes in the strengthening plate and extrusion respectively. As with the extrusion 16 and beam 42, strengthening plate 34 normally comprises multiple discrete pieces or segments aligned longitudinally end to end for the entire length of the waler assembly. Once again, the joints or seams between successive segments of the plate are staggered or offset relative to the joints or seams between successive extrusion pieces, beam segments and float components. This significantly enhances the strength and durability of the waler assembly and dock as a whole.

As further shown in FIG. 3, waler assembly 10 may carry an optional resilient vessel-resistant bumper 86, which may compose an elongate hollow component composed of a resilient material of the type that will be known to persons skilled in the marine industry. Bumper 86 has a convex protruding portion 88 that is engageable by the hull of a vessel and a generally flat base 90 having a fastener hole 91 formed therethrough. The fastener hole aligns with a corresponding hole 92 formed through plate 34. A nut and bolt fastener 96 or other known fastening means are inserted through the aligned fastening holes to secure bumper 86 to strengthening plate 34. As with the other fasteners described in connection with this invention, various connector arrangements and spacings may be employed to secure the bumper along the length of the waler assembly. Likewise, multiple elongate sections of bumper may be utilized, An optional spacer component 98 is inserted through compartment 28 of extrusion piece 16. Spacer component 98 preferably comprises a square tube composed of aluminum or other metal. This provides added metallic thickness and structural integrity to the waler assembly so that the strength is further increased, particularly at the seams formed between the successive adjoining extrusion pieces, beam segments and strengthening plate segments. This provides the wales assembly and the dock with even greater resistance to bending and damage when impacted by strong winds, waves and other harsh marine conditions.

Mounting channels 36, 38 and 40 may be utilized to install various marine accessories onto the dock. These may include cleats, mooring posts and other accessories. For example, these may include utility (e.g. telephone, cable, electric, etc.) stands, fire suppression stands, benches and seating and even additional sections of dock. The channels permit the accessories to be slidably adjusted along the waler assembly to locate the accessory as required for particular applications. The aluminum or other metal composition of the waler assembly and particularly the extrusion pieces 16 enables the waler assembly to effectively resist rotting and thereby premature loosing and failure of the cleats, posts or other accessories.

Figure 4:
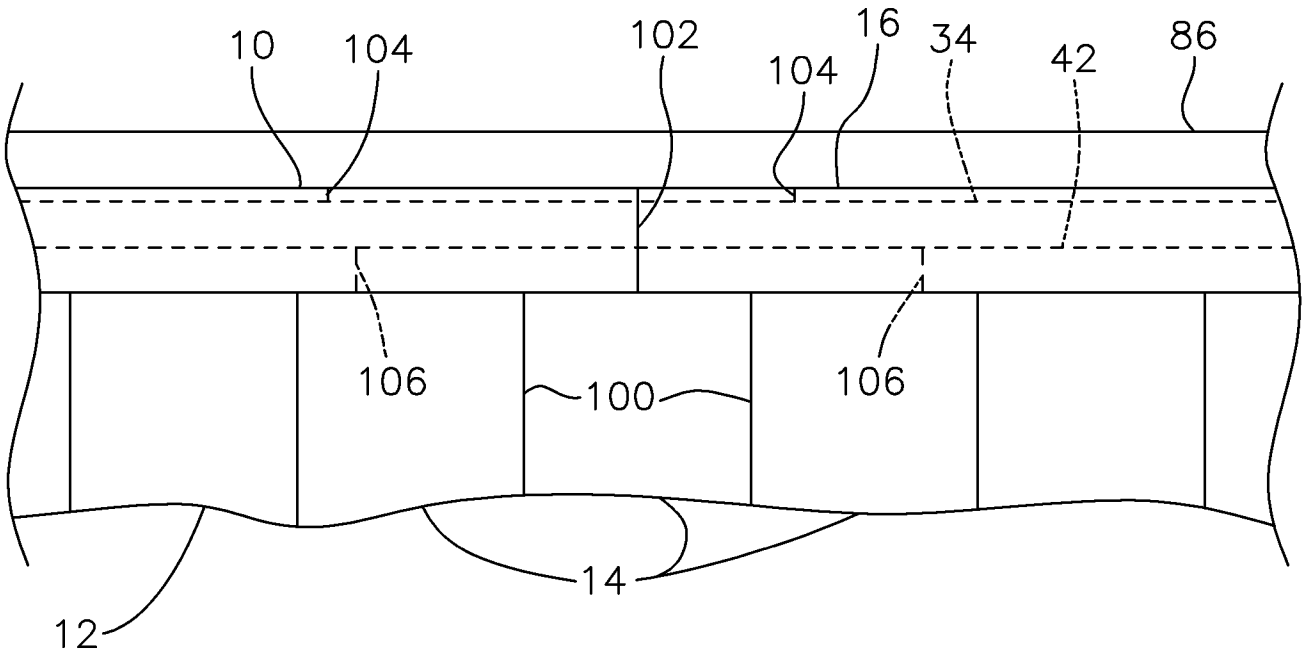
FIG. 4 is a fragmentary top view depicting the wafer assembly as comprised of a plurality of extrusion, beam and strengthening plate segments arranged longitudinally end to end along one side of a series of float components; a vessel-resistant bumper is attached to the waler assembly and the connector elements are omitted for clarity.
Figure 5:
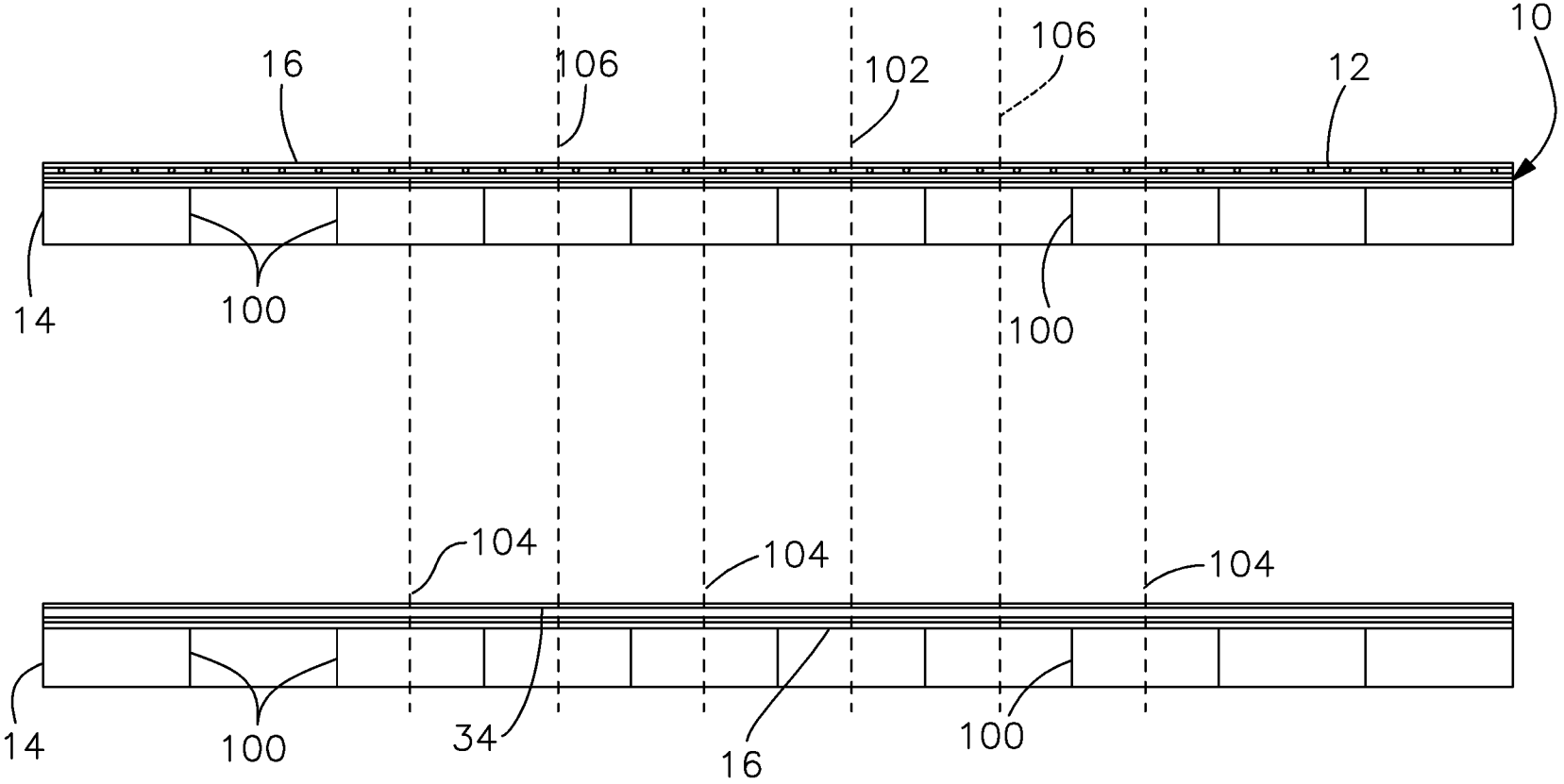
FIG. 5 depicts two elevational side view images of a representative longitudinal section of the waler assembly attached to one side of a series of interconnected float components in a floating dock; the upper image depicts the waler assembly with the strengthening plate removed and the lower image represents the same, positionally corresponding view of the waler with the strengthening plate attached; the dashed vertical lines formed through the corresponding upper and lower images reflect the seams or joints between successive segments of the extrusion, beam and strengthening plate respectively and depict the staggered or offset arrangement of the respective joints employed by the waler assembly and the float components.

A critical aspect of the present invention is that the joints, seams or splices between successive components and segments of the dock and waler system are staggered or offset to improve the strength and structural integrity of the structure. This feature is depicted in FIGS. 4 and 5. More particularly, FIG. 4 is a top view of adjoining segments of the dock and supportive waler assembly. FIG. 5 depicts two corresponding, identically located/positioned images of a representative longitudinal segment of the dock with the strengthening plate 34 removed or omitted in the upper image and installed and exposed in the lower image. Transverse marks 100 represent the joints between successive float components 14 in the dock. Transverse marks comprising dashed vertical lines 102 designate where successive extrusion pieces 16 are split on the corresponding images. Dashed transverse markings 104 likewise represent the locations of the seams formed between successive segments of strengthening plate 34. Analogous transverse markings 106 depict the locations of seams between successive segments of beam 42 in the corresponding upper and lower images. It is important that the seams or joints between adjoining extrusion pieces, beam segments, strengthening plate segments, and float components respectively do not correspond or align with one another. Rather, the seams of these elements are longitudinally offset or staggered relative to one another along the waler assembly 10. As a result, each cross sectional point along the length of the dock and attached waler exhibits, at a minimum, three joint-free and unbroken, solid and very strong laterally abutting structural components featuring seamless cross sectional profiles extending transversely or laterally across the sides of the dock system from the float components through the waler assembly. At all points or locations along the length of waler 10 and supported structure 12, at least three of the abutting extrusion 16, strengthening plate 34, beam 42 and float 14 are unbroken and do not feature a seam. Most simply put, the joints or seams between the successive float components, extrusion pieces, beam segments and strengthening plate segments, respectively, are offset and never aligned. This beneficial structural feature applies at all points along the entire length of the dock and each waler assembly. The multiple unbroken abutting lateral layers of aluminum or other metal components preferably comprising the waler assembly allow the structure to flex or bend under severe stress without breaking. Whereas wood will break when subjected to forces that exceed the structural capacity of the wood, the waler assembly of the present invention is able to withstand such force and resist breakage and failure even when subjected to wind or wave conditions in force and resulting forces that exceed the structural capacity of the system.

The waler assembly of this invention is much stronger and more durable than existing waler systems used for floating docks and walkways. Installing and repairing the waler assembly is much easier, less expensive and less labor intensive than performing repairs on conventional wood structures. The waler assembly effectively resists deterioration and damage even in harsh marine conditions. Eliminating the use of pressure treated lumber also reduces the adverse environmental consequences that often accompany the use of such timber and significantly lengthens the useful service life of the waler assembly. Accordingly, the present invention relates to a significantly improved waler assembly for use in floating docks, walkways and analogous structures.

Although specific features of the invention are shown in some of the drawings and not others, this is for convenience only, as each feature may be combined with any and all of the other features in accordance with this invention.

What is claimed is:

1. A waler assembly for use in a floating platform, which platform has a series of buoyant float components juxtaposed in an elongate arrangement and including a longitudinal side, said waler assembly comprising:

an elongate extrusion for securing to the longitudinal side of the series of float elements, said extrusion including an interior wall for interengaging the longitudinal side of the series of float components, said extrusion being configured to define a compartment, which receives an elongate, beam said beam including an inner panel that is interengaged with said interior wall of said extrusion;

at least one connector interengaging and fastening together said inner panel of said beam and said interior wall of said extrusion and for interconnecting said beam and said extrusion to the longitudinal side of the series of float components; and a strengthening plate attached to an outer portion of said extrusion for covering said compartment with said beam accommodated therein.

2. The assembly of claim 1 in which said extrusion includes a plurality of discrete, adjoining and substantially aligned pieces and each of said beam and said strengthening plate includes a plurality of discrete, adjoining and substantially aligned segments for being arranged end to end along the longitudinal side of the series of float components to form at least one lateral joint in each of said extrusion, said beam and said strengthening plate respectively between adjoining pairs of said extrusion pieces and between adjoining pairs of said beam segments and said strengthening plate segments respectively.

3. The assembly of claim 2 in which said extrusion pieces, said beam segments and said strengthening plate segments are longitudinally staggered relative to one another and said joints in said extrusion, said beam and said strengthening plate respectively are longitudinally offset relative to one another, whereby at all points along the length of said waler, at least two of said extrusion, said beam and said strengthening plate are devoid of a lateral joint.

4. The assembly of claim 3 wherein the series of float components include a series of float component joints, each lateral float component joint being formed between an adjoining pair of the float components, each of said extrusion pieces, beam segments, and strengthening plate segments being staggered relative to the series of float components and each of said joints in said extrusion, said beam and said strengthening plate being offset from each float component joint such that, at all points along the length of said waler, at least three of said extrusion, said beam, said strengthening plate and the series of float components interconnected thereto are devoid of a lateral joint.

5. The assembly of claim 1 in which said extrusion includes top and bottom portions that interconnect said interior wall and said outer portion of said extrusion.

6. The assembly of claim 5 in which said outer portion of said extrusion includes a pair of notches for respectively receiving upper and lower sections of said strengthening plate.

7. The assembly of claim 6 further including at least one fastener that interconnects said strengthening plate to said outer portion of said extrusion.

8. The assembly of claim 6 in which at least one of said notches includes an elongate slot for receiving a respective one of said lower and upper sections of said strengthening plate to hold said strengthening plate in place against said extrusion.

9. The assembly of claim 8 in which said upper section is substantially planar and said lower section is angularly offset from said planar upper section and received in said slot of said extrusion to secure said plate to said extrusion.

10. The assembly of claim 8 in which said beam is defined by an elongate outer channel having a spaced apart pair of upper and lower legs interconnected by said inner panel and respectively interengaging opposing upper and lower walls of said compartment.

11. The assembly of claim 1 in which each said connector includes a threaded connector rod that extends through said inner panel of said beam and said interior wall of said extrusion for interengaging an adjoining float component.

12. The assembly of claim 11 in which said connector rod includes a proximal first end that is threadably engaged by a fastening nut.

13. The assembly of claim 12 in which said connector rod includes an opposite, distal end for extending into a utility trough formed centrally and longitudinally through a respective float component.

14. The assembly of claim 13 further including a metal inner U-channel for mounting in the trough of the float component and for interengaging said distal end of said connecting rod and further including a fastener for attaching to said distal end of said connecting rod to secure said waler assembly to the float component.

15. The assembly of claim 5 in which at least one of the top, bottom and outer portions of said extrusion includes a mounting channel formed unitarily therein for receiving and mounting an accessory to the waler assembly.

16. The assembly of claim 1 in which the extrusion further includes a second longitudinal compartment, which receives an elongate tubular metal spacer for adding structural strength to said waler assembly.

17. The assembly of claim 1 wherein said strengthening plate includes an outer surface for interengaging and attaching to a vessel-cushioning bumper.

18. The assembly of claim 17 further including a threaded bumper connector that is interengaged through aligned fastening holes in said strengthening plate and a bottom surface of said bumper such that said bumper connector extends into said compartment of said extrusion.

19. The assembly of claim 18 in which said bumper connector includes a threaded element that is secured to said strengthening plate by a fastening nut.

20. A waler assembly for use in a floating platform, which platform has a series of buoyant float components juxtaposed in an elongate arrangement and including a longitudinal side, said waler assembly comprising:

an elongate extrusion for securing to the longitudinal side of the series of float elements, said extrusion including an interior wall for interengaging the longitudinal side of the series of float components, said extrusion being configured to define a compartment, which receives an elongate beam, said beam being interengaged with said interior wall of said extrusion;

at least one connector interengaging and fastening together said beam and said interior wall of said extrusion and for interconnecting said beam and said extrusion to the longitudinal side of the series of float components; and a strengthening plate attached to an outer portion of said extrusion for covering said compartment with said beam accommodated therein.

* * * * *